US009466301B2

(12) United States Patent
Lannes

(10) Patent No.: US 9,466,301 B2
(45) Date of Patent: Oct. 11, 2016

(54) SYSTEM AND METHOD FOR LINEAR FREQUENCY TRANSLATION, FREQUENCY COMPRESSION AND USER SELECTABLE RESPONSE TIME

(71) Applicant: Kenneth John Lannes, New Orleans, LA (US)

(72) Inventor: Kenneth John Lannes, New Orleans, LA (US)

( * ) Notice: Subject to any disclaimer, the term of this patent is extended or adjusted under 35 U.S.C. 154(b) by 0 days.

(21) Appl. No.: 14/693,373

(22) Filed: Apr. 22, 2015

(65) Prior Publication Data

US 2015/0228285 A1 Aug. 13, 2015

Related U.S. Application Data

(63) Continuation-in-part of application No. 13/671,160, filed on Nov. 7, 2012, now abandoned.

(51) Int. Cl.

| | |
|---|---|
| ***G10L 21/00*** | (2013.01) |
| ***G10L 19/00*** | (2013.01) |
| ***G10L 21/003*** | (2013.01) |
| ***G10H 7/02*** | (2006.01) |

(52) U.S. Cl.

CPC ..... *G10L 19/00* (2013.01); *G10H 7/02* (2013.01); *G10L 21/003* (2013.01); *G10H 2250/571* (2013.01)

(58) Field of Classification Search

USPC ..... 704/500–504; 330/126; 708/314, 420

See application file for complete search history.

(56) References Cited

U.S. PATENT DOCUMENTS

| | | | | |
|---|---|---|---|---|
| 4,025,772 | A * | 5/1977 | Constant | G06F 17/15 708/314 |
| 5,014,235 | A * | 5/1991 | Morton | G06F 5/015 365/185.11 |
| 5,241,372 | A * | 8/1993 | Ohba | H04N 5/2628 348/578 |
| 5,880,973 | A * | 3/1999 | Gray | H03H 17/0671 375/350 |
| 5,896,397 | A * | 4/1999 | Tolhuizen | G11B 20/1813 360/53 |
| 5,980,097 | A * | 11/1999 | Dagnachew | H03H 17/0664 365/45 |
| 6,446,039 | B1 * | 9/2002 | Miyazawa | G10L 15/06 704/250 |
| 8,160,888 | B2 * | 4/2012 | Breebaart | H04S 3/008 704/500 |
| 2007/0027945 | A1 * | 2/2007 | McGrath | H04S 7/305 708/420 |
| 2012/0256684 | A1 * | 10/2012 | Sorrells | H03F 1/0294 330/69 |

* cited by examiner

*Primary Examiner* — Jesse Pullias
(74) *Attorney, Agent, or Firm* — Juan J. Lizarraga

(57) ABSTRACT

A method and system has been developed and demonstrated which provides real-time frequency translation, frequency compression, and user selectable response time for non-deterministic signals. This method and system provides for the real-time separation and isolation of theoretically an infinite amount of frequencies present in an incoming non-deterministic signal. The bandwidth of the filter for the separated frequencies is user selectable and provides varying rise times for the individual frequencies. The linear frequency shifting property of the algorithm creates bandwidth compression opportunities while signals are present in a channel for transmission.

14 Claims, 11 Drawing Sheets

SYSTEM AND METHOD FOR LINEAR FREQUENCY TRANSLATION, FREQUENCY COMPRESSION AND USER SELECTABLE RESPONSE TIME

This application is a continuation-in-part of application Ser. No. 13/671,160, (the '160 application) filed Nov. 7, 2012. The '160 application is incorporated here by reference.

BACKGROUND OF THE INVENTION

Since the mid 70's music synthesizer companies have been attempting to adapt keyboard synthesizer technology to other non-keyboard (non mechanical switch activated) instruments such as guitars, brass, woodwinds, etc. The common techniques involved analog circuit processing which evaluated the frequency and amplitude of incoming musical notes, and then attempted to drive an electronic oscillator to duplicate these characteristics with user selectable parameters. These circuits and processes were pioneered by companies (some now defunct) such as Moog and ARP. However, the techniques were only moderately successful and always required modification to the instrument by way of attached, extraneous hardware. These techniques did not allow for reliable, successful processing by the circuitry and the musician suffered in that he/she could not play in their regular fashion. Even after the musician adapted their technique in an effort to help accommodate the processor, there was not 100% success. Articles have been written about the failure of these devices and industry analysts have even blamed the ARP product (the Avatar) for the downfall of the company.

As the music industry moved into the 1980's, MIDI (Musical Instrument Digital Information format) was developed as an industry wide communication protocol such that synthesizers from other manufacturers could communicate with each other and also computer systems. This prompted the synthesizer companies to revisit the technologies which could potentially once again allow other non-keyboard instruments to provide MIDI information to other synthesizers and computers. While there has been some success in this arena, there is still the problem of tracking (getting the hardware to follow all the nuances of the musician's playing). One of the more successful companies which provides guitar synthesizers is Roland. However the technology limitations are still rather severe:

1. The musician must modify their instrument or be required to buy a Roland instrument which can be costly. This also prevents the musician from using their favorite instrument. Furthermore, this generally prohibits musicians from using valuable vintage instruments as modifying them with the necessary hardware would devalue them.
2. The present day MIDI converters for guitars and other instruments can NOT keep up with the musician. The fastest players can confuse and "leave behind" even the best MIDI guitar synthesizer systems resulting in a failure of the synthesizer to play all the notes the musician is playing.
3. The present day MIDI converters also require custom pickups for polyphonic (multi-note) instruments such as guitars, basses, violins, etc. and these signals must be separately sent to the processor, each on their own physical conductor. This eliminates the ability for the musician to use not only a simple single conductor cable, but eliminates the possibility of using other systems such as wireless transmitters.

The method and system outlined in this present invention eliminates all of these issues and in addition offers capabilities that the present manufacturers don't offer. Some of these capabilities would be the processing of 12-string guitars, 8-string basses, gut string basses, and 7-string guitars just to name a few. In fact, the process is so robust, it can process ANY sound from any instrument or recording, even old analog recordings with no digital information on them.

Furthermore the linear frequency shift capabilities of this process allow for not only musical applications, but also bandwidth compression applications which would benefit a wide variety of digital data transmission techniques.

BRIEF SUMMARY OF THE INVENTION

It is an object of this invention to provide a system for linear frequency translation, frequency compression, and user selectable response time comprising a signal processing window to receive and split the an incoming signal into two separate signals, one duplicate of the incoming signal, and one time-reversed of the incoming signal, or to receive two separate signals where said signal processing window contains and comprises at least two memory locations and two multipliers and two summers, where at least one of the signals is decimated before being fed into the signal processing window. It is further intended that the summers, memory locations, and decimators may be constructed by either analog or digital circuits or a combination of both.

It is another object of this invention to provide a method which outlines the proper steps for said system to execute linear frequency translation, frequency compression, and user selectable response time comprising a signal processing window to receive and split the incoming signal into two separate signals, one duplicate of the incoming signal, and one time-reversed of the incoming signal, or to receive two separate signals where said signal processing window contains and comprises at least two memory locations and two multipliers and two summers, where at least one of the signals may be decimated before being fed into the signal processing window. It is further intended that the summers, memory locations, and decimators may be constructed by either analog or digital circuits or a combination of both.

The method and system of the present invention multiplies and sums an incoming signal with itself in the opposite direction. By doing this, this creates the affect of "two trains" (two signals) passing each other and the output signal contains all of the input frequencies doubled with no distortion or intermodulation products. This is a result of the relative movement between the two signals (two trains). This is in essence a dynamic matched filter. Although the match is not perfect in the classical sense of matched filtering, it is extremely effective and provides isolation of the signal. Matched filtering is well known in the art. Furthermore, the present invention has no issues of any kind with respect to data overflows or voids in realtime. The method is comprised of multipliers and summers and shift registers, or memory locations if preferred, and is shown in FIG. 1. The power of this method is that a frequency can enter the multiply/sum window and there will be no output until the signal "sees itself" coming in from the other direction, even if a previous, different frequency is previously left over in the multiply-sum window. The new frequency is orthogonal to the previous frequency since they are different and will not give an output until it sees its own "image", or matched response coming from the other direction. The rise time of each individual frequency is proportional to the multiply-sum window length. So no matter how many frequencies are input simultaneously, and no matter how much their amplitudes may vary, there will be no output due to any individual frequency until it is "matched" with its mirror image entering the window from the opposite side. Each frequency will have its own slow attack (much like a violin) without the necessity of any analog type processing based on thresholding or frequency measurement. This has been built and demonstrated in realtime.

By decimating one input (but not necessarily both) the relative velocities between the input signal and another signal entering the multiply-sum window from the other direction can be changed. Care must be taken to maintain the "matched filtering" characteristic during decimation, but when this is done, other integer values of frequency shifting can be accomplished other than just a frequency doubling. Other frequency shifting values can also be obtained by sending the decimated and un-decimated signals in the SAME direction in the multiply-sum window, once again, as long as the "matched filtering" characteristic is met.

The separation of multiple signals present on one conductor simultaneously has been plaguing guitar synthesizers for decades. Past patents have attempted to solve these problems but failed and are shown in the prior art. "Classical frequency measurement techniques" describes methods such as fast-Fourier transforms and time domain measurement of periods. It may also refer to thresholding techniques used to distinguish when new signals are generated by the user. This is an inadequate approach since new signals generated by the user can be very small and "slip under" classical thresholding type methods. Other techniques use polyphonic electromagnetic pickups, which again the method of the present invention eliminates the need for. Much of the prior art listed are attempts to design more robust methods for users to control music synthesizers. None of them achieve the robustness of the method of the present invention. Some apply to the subject matter more than others but all are attempts to provide music synthesizer controllers to musicians.

PRIOR US PATENTS

Below is a list of prior US patents that attempted to solve those problems solved by the present invention:

- U.S. Pat. No. 8,193,437 is an electric music and guitar system that uses a screen display and user controller. It does not use the method of the present invention.
- U.S. Pat. No. 8,178,773 is a GUI and control interface for a synthesizer. It does not use anything close to the method of the present invention to process signals.
- U.S. Pat. No. 8,173,884 requires manual input from the user for synthesizer type sounds. This is basically a synthesizer controller and does not use the method of the present invention.
- U.S. Pat. No. 8,168,877 uses classical periodicity measurements. These approaches are inferior to the method of the present invention and cannot process multiple frequencies on a single conductor.
- U.S. Pat. No. 8,143,509 requires and uses a polyphonic pickup (hexaphonic for 6 string guitar). The method of the present invention eliminates the need for polyphonic pickups.
- U.S. Pat. No. 8,093,486 is a guitar system that uses a touch screen to help control the music synthesizer. It does not use the method of the present invention.
- U.S. Pat. No. 8,067,683 is a device for storing and sustaining a note played and does not use the method of the present invention.
- U.S. Pat. No. 8,030,567 is a general music instrument controller and does not use the method of the present invention.
- U.S. Pat. No. 8,030,560 measures pitch and amplitude using classical techniques and provides modulation of those parameters which is totally different from the method of the present invention.
- U.S. Pat. No. 8,030,565 uses classical gain and feedback techniques to measure the incoming signal which is totally different from the method of the present invention.
- U.S. Pat. No. 7,985,917 uses classical frequency measurement techniques. This is totally different from and falls short of the robustness of the method of the present invention.
- U.S. Pat. No. 7,982,124 uses a theremin and signal generators which is totally different from the method of the present invention.
- U.S. Pat. No. 7,973,232 is a virtual instrument used as a controller for a music synthesizer. This is totally different from and falls short of the robustness of the method of the present invention.
- U.S. Pat. No. 7,960,640 uses classical band-pass filtering and pitch detection. These band-pass filters are not adaptable automatically and in real time such as the method of the present invention. Furthermore, the method of the present invention does not use pitch detection.
- U.S. Pat. No. 7,877,263 uses auto-regressive, linear predictive coding, and Burg's method to process the audio signal, which is totally different from the method of the present invention.
- U.S. Pat. No. 7,865,257 uses MIDI and a GUI for user interaction and programming which is totally different from the method of the present invention.
- U.S. Pat. No. 7,858,870 uses MIDI, triggers, and images to allow the user to trigger the synthesizer. This is totally different from and falls short of the robustness of the method of the present invention.
- U.S. Pat. No. 7,829,778 is a model for characterizing musical pitches and assigning them to a circular map in order to generate harmonics. This is totally different from and falls short of the robustness of the method of the present invention.
- U.S. Pat. No. 7,816,599 synthesizes a note in between two successive notes. The method of the present invention is not concerned with this approach or end result.
- U.S. Pat. No. 7,812,244 Uses a photodetector in order to convert vibrating strings to MIDI information. This is totally different from and falls short of the robustness of the method of the present invention.
- U.S. Pat. No. 7,799,986 is a guitar synthesizer which requires a hexaphonic pickup and converts the pitch information into a serial digital data stream. The method of the present invention can be applied to guitars but eliminates the need for a hexaphonic pickup and does not generate a digital data stream.
- U.S. Pat. No. 7,786,370 uses MIDI, other digital signaling and multiple oscillators. This is totally different from and falls short of the robustness of the method of the present invention.
- U.S. Pat. No. 7,767,902 is for the autoharp and uses string isolation transducers and drive transducers. The method of the present invention eliminates the need for string isolation transducers.

U.S. Pat. No. 7,718,883 is for composing harmonically related music by a computer. This is totally different from and falls short of the robustness of the method of the present invention.

U.S. Pat. No. 7,705,231 uses a Hiddon-Markov model and other standard frequency domain analysis techniques to generate chords and harmonics. This is totally different from and falls short of the robustness of the method of the present invention.

U.S. Pat. No. 7,667,131 uses transducers to sense and drive the string vibrations. The method of the present invention does not require transducers to drive string vibrations.

U.S. Pat. No. 7,598,450 uses an invented fretboard with multiple sensors on the fretboard. The method of the present invention does not require any of the hardware used in this invention.

U.S. Pat. No. 7,514,620 is only a pitch transposer using classical methods. This is totally different from and falls short of the robustness of the method of the present invention.

U.S. Pat. No. 7,432,435 generates new tones by comparing a present tone with tones in memory. This is totally different from and falls short of the robustness of the method of the present invention.

U.S. Pat. No. 7,427,710 is a polyphonic pickup (hexaphonic for standard guitar). The method of the present invention eliminates the need for a polyphonic pickup.

U.S. Pat. No. 7,375,276 uses a hexaphonic pickup. The method of the present invention eliminates the need for a polyphonic pickup.

U.S. Pat. No. 7,309,829 uses a hexaphonic pickup and MIDI commands. The method of the present invention eliminates the need for a polyphonic pickup and doesn't require any MIDI commands.

U.S. Pat. No. 7,309,828 uses hysteresis to generate new waveforms and harmonics. This is totally different from and falls short of the robustness of the method of the present invention.

U.S. Pat. No. 7,003,120 uses classical frequency domain processing. This is totally different from and falls short of the robustness of the method of the present invention.

U.S. Pat. No. 6,995,311 uses a polyphonic pickup and its primary function is a tuner. The method of the present invention eliminates the need for a polyphonic pickup.

U.S. Pat. No. 6,881,890 uses conventional thresholding techniques and frequency measurement. This is totally different from and falls short of the robustness of the method of the present invention.

U.S. Pat. No. 6,849,795 uses classical synthesizer envelope techniques and multiplying harmonic generators. This is totally different from and falls short of the robustness of the method of the present invention.

U.S. Pat. No. 6,513,007 characterizes speech signals to modulate an instrument signal. This does not use the method of the present invention.

U.S. Pat. No. 6,143,974 uses frequency coefficient calculations and then alters the coefficients to generate new signals. This is totally different from and falls short of the robustness of the method of the present invention. The present invention does not use any frequency coefficients.

U.S. Pat. No. 6,046,396 uses digital/analog tone generators once a frequency is detected. This is totally different from and falls short of the robustness of the method of the present invention. The present invention does not use any tone generators.

U.S. Pat. No. 6,046,395 is a pitch transposer which accomplishes this by changing the sampling rate of signals. This is totally different from and falls short of the robustness of the method of the present invention.

U.S. Pat. No. 5,986,198 is the same as U.S. Pat. No. 6,046,395.

U.S. Pat. No. 5,945,621 uses classical pitch detection techniques and generates a new tone based on this data. This does not use the method of the present invention.

U.S. Pat. No. 5,942,709 uses classical pitch detection and adaptive filtering based on detected frequency values. This is totally different from and falls short of the robustness of the method of the present invention. The present invention does not detect any frequency values.

U.S. Pat. No. 5,936,182 uses classical frequency overtone detection and generation using multipliers and filters. This is totally different from and falls short of the robustness of the method of the present invention.

U.S. Pat. No. 5,929,360 is a MIDI converter using transducers instead of electro-magnetic pickups. This does not use the method of the present invention which does not require or use MIDI.

U.S. Pat. No. 5,920,843 uses time division multiplexing and classical thresholding and processing techniques for frequency and amplitude measurement. This is totally different from and falls short of the robustness of the method of the present invention.

U.S. Pat. No. 5,900,568 uses classical measurement and error correction feedback loops for synthesis. This is totally different from and falls short of the robustness of the method of the present invention.

U.S. Pat. No. 5,824,937 uses neural networks which is totally unlike the method of the present invention. The present invention does not use or require neural networks.

U.S. Pat. No. 5,747,714 uses classical thresholding and period (frequency) counting techniques. This is totally different from and falls short of the robustness of the method of the present invention.

U.S. Pat. No. 5,717,155 uses a hexaphonic pickup and classical frequency measurement techniques. The method of the present invention eliminates the need for hexaphonic or polyphonic pickups.

U.S. Pat. No. 5,619,004 is very close to the present invention but correlates the incoming signal to lag adjusted images of the incoming signal and chooses the best match for frequency measurement. It then uses further frequency measurements and adjustments through feedback loops. It does not use the method of the present invention. Other patents addressing bandwidth or frequency compression also failed to use the system and method of the present invention.

U.S. Pat. No. 8,225,168 is a data transmission scheme for a multiple-input-multiple-output data transmission system. This approach does not use the method of the present invention for data transmission or bandwidth compression.

U.S. Pat. No. 8,225,185 uses a Reed-Soloman coding system. This approach does not use the method of the present invention for data transmission or bandwidth compression.

U.S. Pat. No. 8,225,167 is a receive/transmit system with no compression. It is unlike the method of the present invention.

U.S. Pat. No. 8,225,084 is a data authentication system. It is unlike the method of the present invention.

U.S. Pat. No. 8,224,940 uses Bloom filters and is unlike the method of the present invention.

U.S. Pat. No. 8,225,370 is a general digital compression technique for GPS. This approach does not use the method of the present invention for data transmission or bandwidth compression.

U.S. Pat. No. 8,225,109 is a digital compression technique. Being a digital technique, this approach does not use the method of the present invention for data transmission or bandwidth compression.

U.S. Pat. No. 8,224,980 is a digital parsing and compression technique. This approach does not use the method of the present invention for data transmission or bandwidth compression.

U.S. Pat. No. 8,224,705 calculates the required bandwidth of a signal but doesn't use compression. It is unlike the method of the present invention.

U.S. Pat. No. 8,224,295 is a system that makes RF router provisions. It is unlike the method of the present invention.

U.S. Pat. No. 8,223,769 uses digital packet reduction techniques to reduce the required bandwidth. This approach does not use the method of the present invention for data transmission or bandwidth compression.

U.S. Pat. No. 8,223,706 uses digital packet compression. This approach does not use the method of the present invention for data transmission or bandwidth compression.

U.S. Pat. No. 8,214,871 uses filters and FFTs. The method of the present invention does not use FFTs (Fast Fourier Transforms).

U.S. Pat. No. 8,213,368 uses adaptive filters. Although the method of the present invention is a type of adaptive filter, it is not like classical adaptive filtering used by U.S. Pat. No. 8,213,368.

U.S. Pat. No. 8,209,430 uses digital formatting and information to adjust the required bandwidth. This U.S. approach does not use the method of the present invention for data transmission or bandwidth compression.

U.S. Pat. No. 8,205,011 is a method for formatting digital data for transmission. This approach does not use the method of the present invention for data transmission.

BRIEF DESCRIPTION OF THE DRAWINGS

FIG. 5 shows the implementation of required memory circuits if there is an even number of memory circuits used.

DETAILED DESCRIPTION OF THE INVENTION

Figure 1:
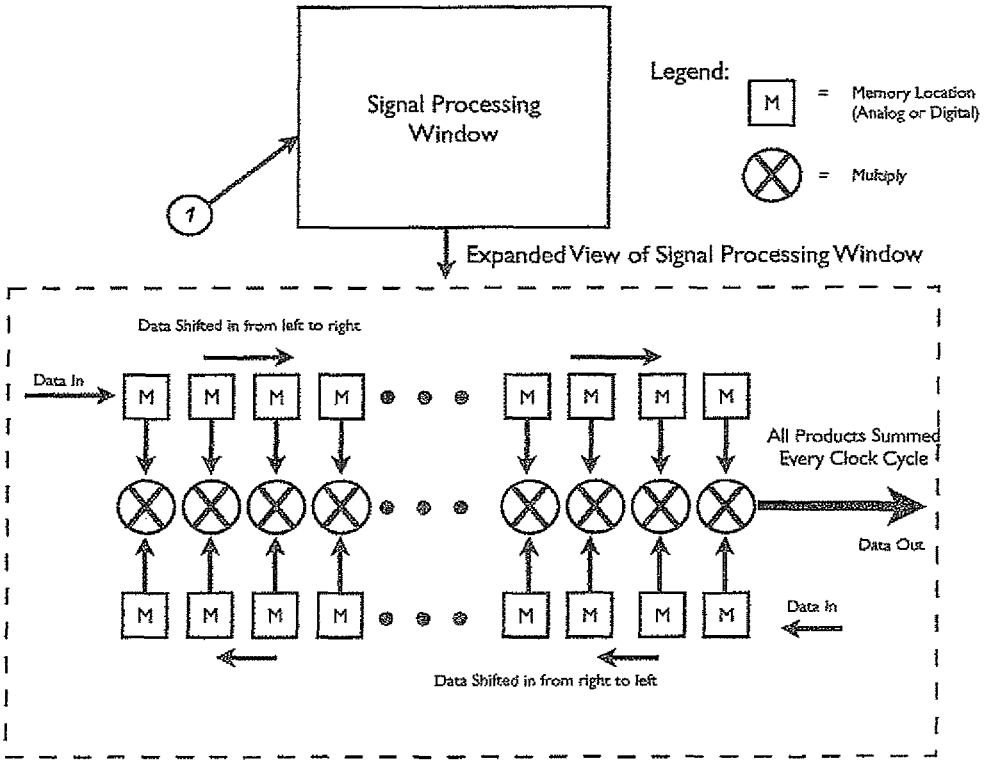
FIG. 1 shows the method and system in an electrical circuit implementation of the multiply-sum window. The window is designated as item 1. This is an example only and shown for clarity.
Figure 2:
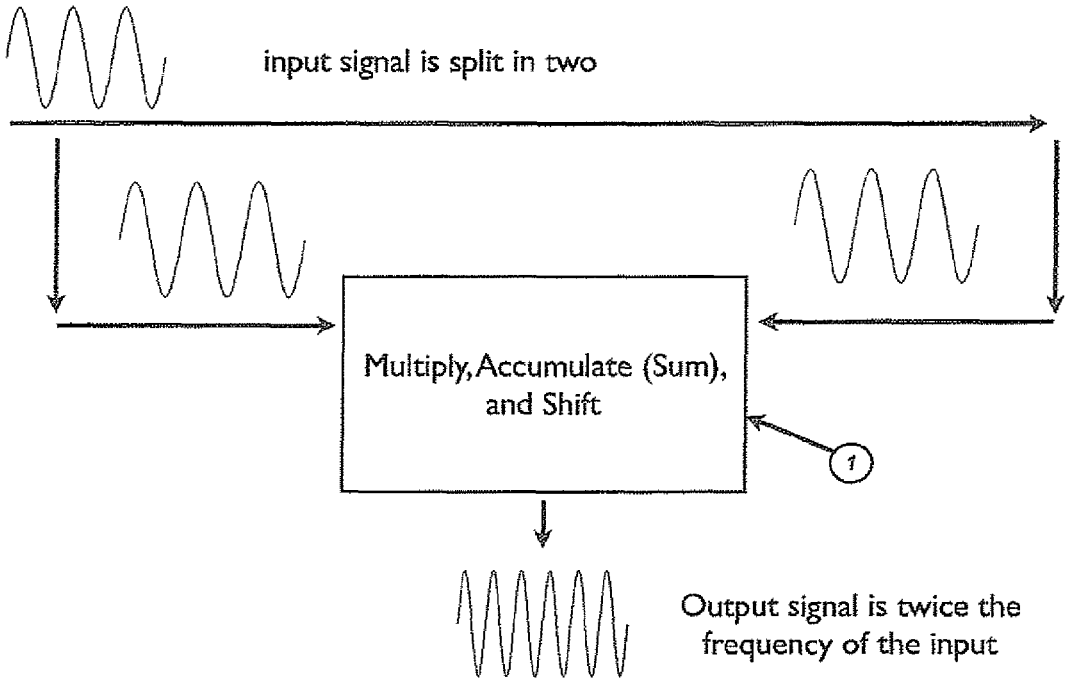
FIG. 2 shows the process in its simplest, most minimal form. The window is designated as item 1.

FIG. 1 shows the basic construction of the processing window. Referring to FIG. 2, a non-deterministic signal is split into two signal paths. The signal can be non-periodic or periodic, and does not have to be sinusoidal.

FIG. 2 shows a sinusoidal signal for ease of visualization. The signal is digitized and a multiply-sum window (item 1) is created with digital or analog memory locations. The amount of memory locations can be any value from 2 or greater. A window multiplies each corresponding data point of the two functions as they "pass" each other and then-sums them all together (as shown in FIG. 1). The most unique feature of this circuit is that both signals are moving. This is very close to classical convolution; however classical convolution requires that one signal be stationary. Each time the signals move to the next memory location, the multiplication and summation are repeated. Because the signals are derived from the same signal, their fundamental frequencies are the same. That is, the "peaks" and "valleys" of the signals occur at the same interval of memory locations. This is an important aspect of this method as it will be shown that the output frequency is not necessarily the frequency of the input signal but is created due to the relative movement between the two split signals. If this criterion is not met, the signals will be orthogonal and when the summation occurs, the output will be zero or greatly attenuated. This is the "matched filtering characteristic". Once again, this is why when a new signal enters the window it does not matter if the window is already full with a previous signal. The new signal is not processed until it sees "itself" at the middle of the window from the other direction. If the window is large enough, linearity ensues and each frequency, however many, is processed separately. In essence each frequency in the window gets its own bandpass filter employed around it. This is how the circuit can process any number of notes from an instrument even if all the notes are contained on the same conductor such as a "quarter inch" instrument cable commonly found in the music industry.

Figure 3:
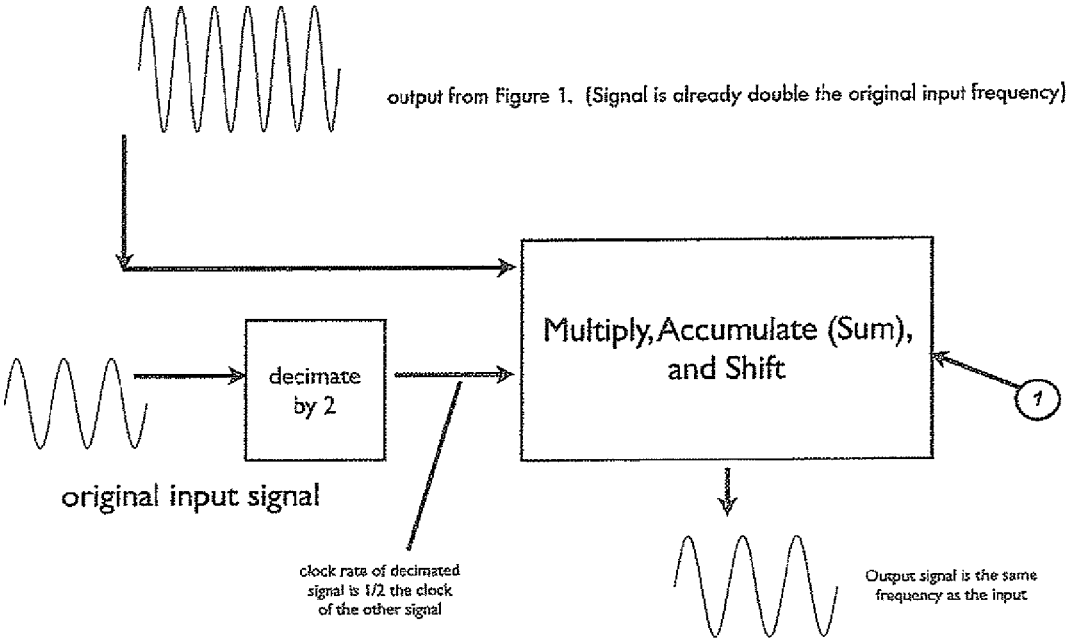
FIG. 3 shows a slight variation on the basic circuit to achieve other frequencies. The primary difference is the decimation and the two signals being fed in the same direction inside the window. The window is again shown as item 1.

Referring to FIG. 3, if the output of FIG. 2 is sent to a second multiply-sum window, the original frequency can be obtained by slightly modifying the process with the original unprocessed signal. In FIG. 3 the output of FIG. 2 is sent into the multiply-sum window (item 1) in the same direction as the original signal (in FIG. 3, both signals enter from the left) however, the original signal is decimated by 2 and also shifted, or clocked, into the multiply/sum window at half the rate as the other signal being fed from FIG. 2. If the clock rate is reduced by the same amount as the decimation, the matched filter requirement will still be met inside the multiply-sum window; however the relative velocity of the two signals traveling in the same direction will be changed.

For the case of a decimation by 2, the original fundamental frequency will be outputted from the multiply-sum window. This is still useful because now each note has its own separate rise time, or attack, and the musician can choose to play the original note (frequency) instead of a frequency double of what was originally played. Furthermore, the musician can choose user selectable attack times (by changing the signal processing window length) in order to simulate other instruments not like their own. By using the "direction reversal" technique combined with different decimation rates, a multitude of new frequency shifts can be accomplished.

Figure 4:
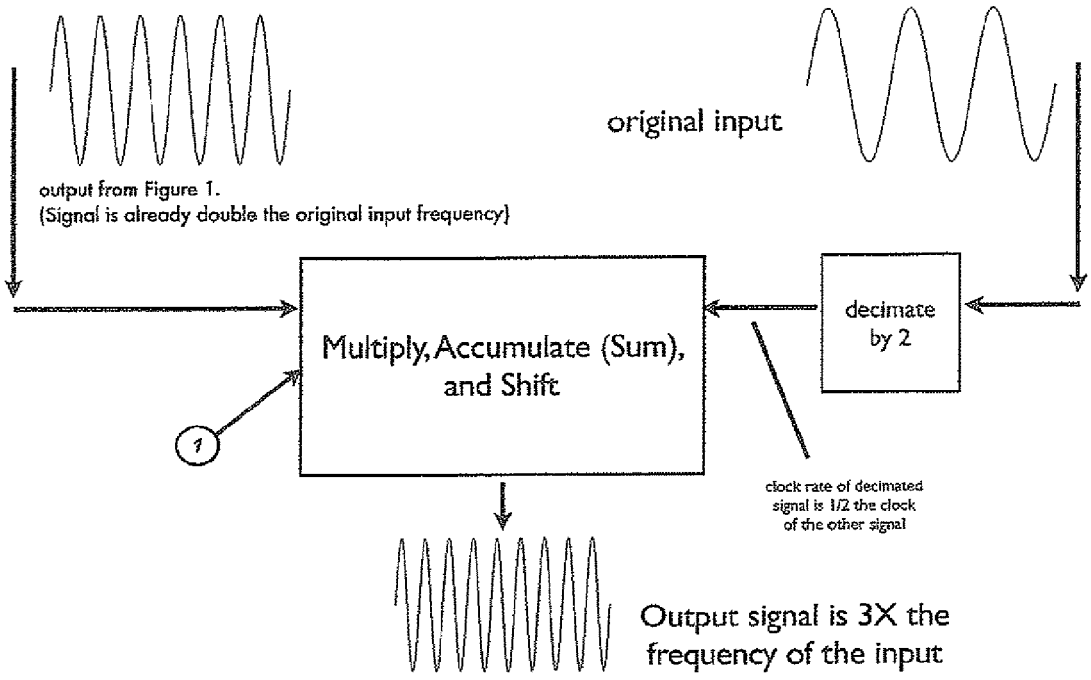
FIG. 4 shows another slight variation on the basic circuit. It's the same as FIG. 3 except that the signals are fed in opposite directions inside the window. The window is again shown as item 1.

For example, FIG. 4 shows the same process as FIG. 3, however we have returned to the concept of sending the signals "at each other" in different directions. Because of the decimation and reduced clock rate, the relative frequency between the two functions will now create an output at 3 times the original input fundamental frequency instead of 4 times the original input frequency.

If the multiply-sum window is reduced to one point, the result of this is simply applying the square (raised to the power of 2) to the incoming signal. The length of the multiply-sum window, which is two registers or greater, creates a critical filter which removes the unwanted harmonics a normal square function would create. This filtering action creates a linear frequency shifting method and is a critical feature that separates this method from other frequency shifting approaches such as simple multiplication. Up and down frequency conversion by multiplication is how radio has worked for 100 years and is well known in the art, but simple multiplication also creates many unwanted (intermodulation) frequencies. The linear frequency translation feature of the present invention allows the user to compress the frequency before transmission the same amount that it will be translated on the receiving end which allows for bandwidth compression in the channel.

The multiply-sum window has a uniform amplitude across the window. This creates a "box" window in the time domain. The equivalent frequency response of this is a sine function in the frequency domain and the relationship between the length of the box and the response of the sine is a reciprocal relationship and is well known in the art. The shorter the window, the larger the bandwidth of the filter, and the larger chance that unwanted frequencies can be passed through. Even though this can possibly be desirable depending on the user, it has been an obstacle to previous non-linear frequency translation methods which the method of the present invention overcomes. Unwanted frequencies could be defined by the user. Additional window weighting such as, but not limited to, triangle, gaussian, Hamming, Hanning, etc. can also be applied inside the multiply-sum window which allows a shortening of the window and thus a shortening of the rise time of the output, while providing greater suppression of unwanted frequencies compared to a simple uniformly weighted "box" window. This additional window is distributed over the convolution window and is stationary compared to the signals being shifted through.

Figure 5:
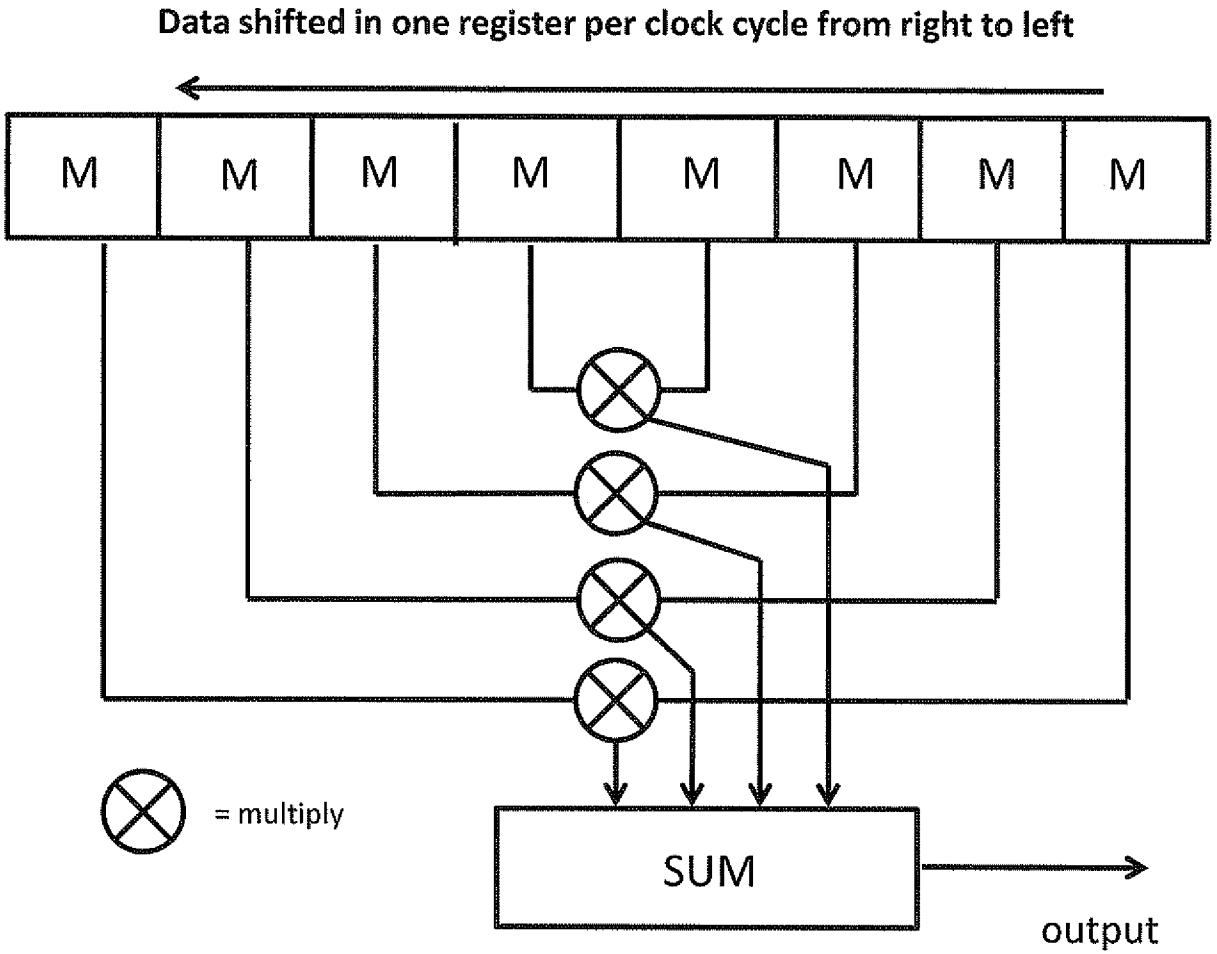
FIG. 5 shows the method and system in an electrical circuit implementation of the signal processing window. However, unlike most convolution type processing windows, only one set of memory circuits is required. The feedback paths provide the proper order of processing. Also.

FIG. 5 shows the basic construction of the processing circuitry. The input, a non-deterministic signal, does not have to be split into two signal paths. Furthermore, this approach reduces the amount of memory circuits by 50%. Instead of two signals "passing" each other in opposite direction, which is clearly outlined in Constant (U.S. Pat. No. 4,025,772), only one signal path is required. The feedback paths provide the necessary circuitry to emulate this system and method which will provide the same result as cross-correlating two independent signal paths but only requiring one signal path. It is proven that this, more optimal circuit using only 50% of the required memory circuits of conventional auto-correlation, is the same as a conventional convolution. For example, if we take the $8^{th}$ output data point after the sequences have met in the middle of the processing window of the conventional technique, this $8^{th}$ data point would be defined as:

$$\mathrm{OUTPUT}_8 = x_1 * x_8 + x_2 * x_7 + x_3 * x_6 + x_4 * x_5 + x_5 * x_4 x_6 * x_3 + x_7 * x_2 + x_8 * x_1$$

By using the feedback paths shown in FIG. 5, this same result is achieved once the input sequence has advanced only 4 memory circuits to the left of the center of the memory circuits. It is also shown that although the input sequence advances as a given clock rate $\mathrm{FREQ}_{clk}$, the output sequence will have frequency content which has been doubled. This is a true optimization and is different from all prior art for the following reasons:

1. Only half of the required memory circuits of prior art is required for this method and system.
2. There is no requirement to time reverse the incoming signal. Any reference in prior art to inducing phase shifts or time reversing any signal with reference to another or itself is negated and not required by this method and system.
3. Due to the feedback paths, the output sequence is advanced at the same rate as if two independent signal paths, as outlined in prior art, are passed in opposite directions and the frequency of the output signal is double the frequency of the input signal even though only one clock is required for only the input signal.

Figure 6:
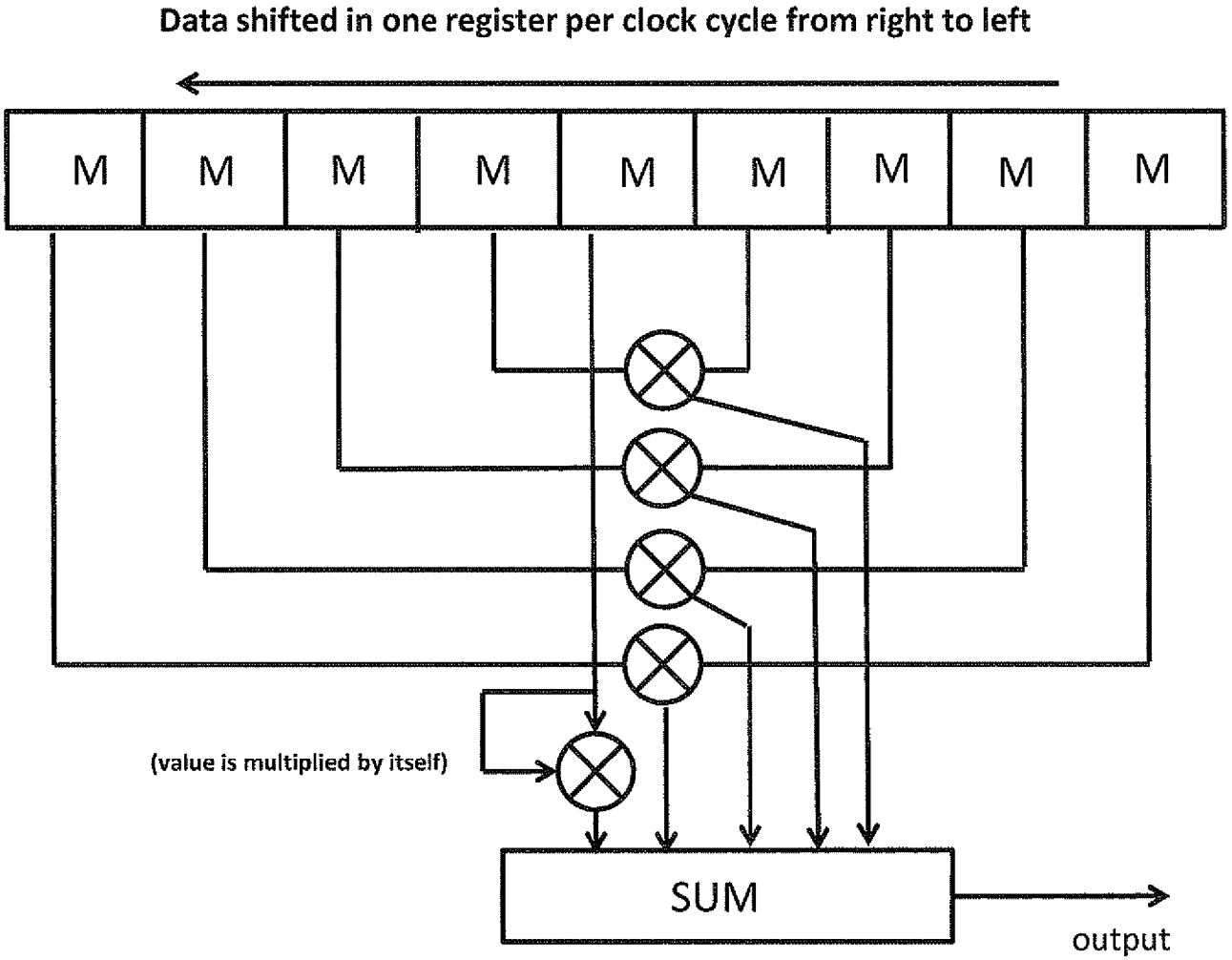
FIG. 6 shows the method and system in an electrical circuit implementation of the signal processing window, if an odd number of memory circuits is used.

This system and method can be implemented by using either an even number of memory circuits or an odd number of memory circuits. FIG. 6 shows the circuitry signal flow with an odd number of memory circuits.

Figure 7:
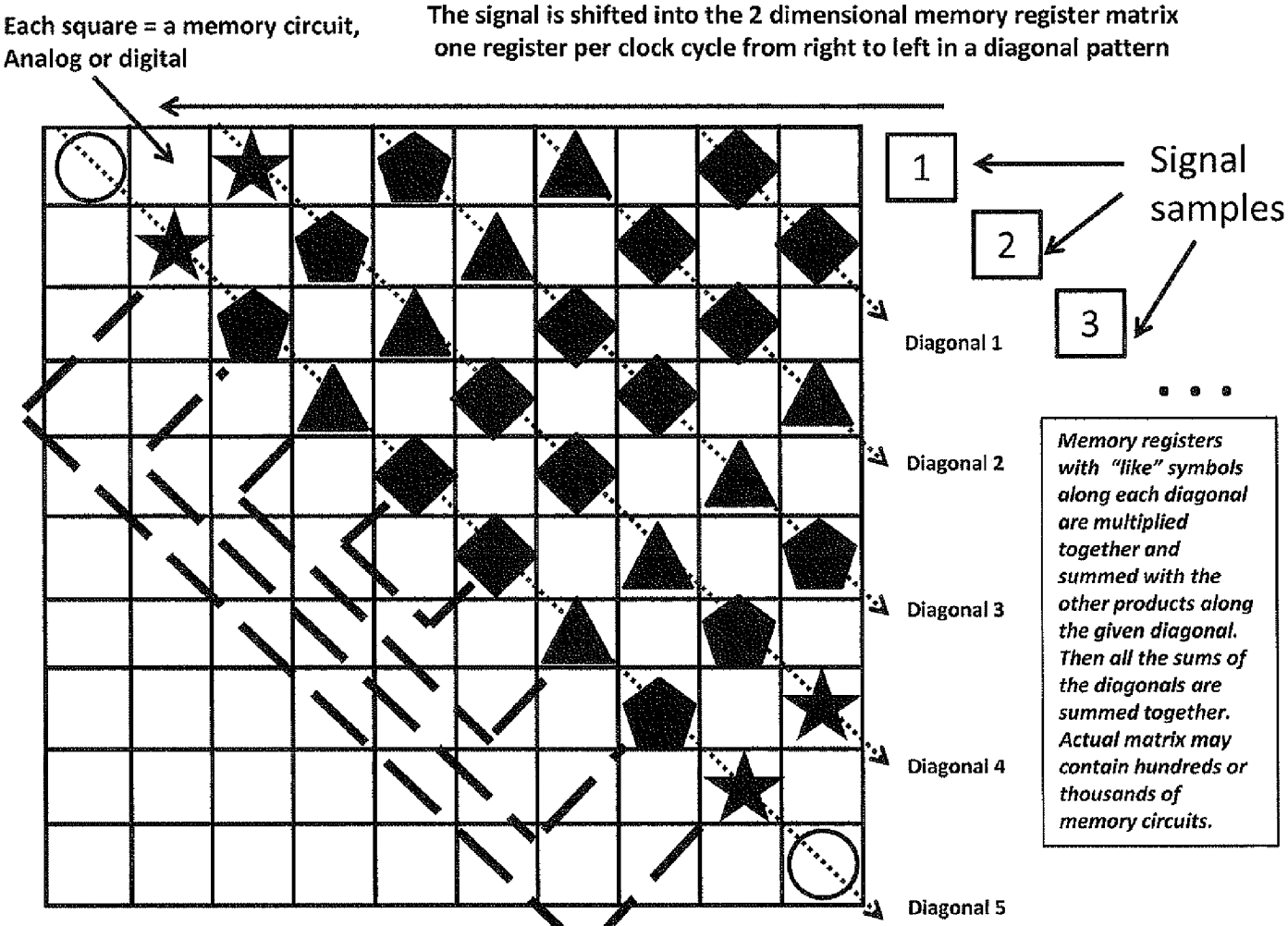
FIG. 7 shows the implementation of the present method and system by using memory circuits configured in a matrix configuration. The input signal is fed in from the upper right corner and an output is created immediately.
Figure 8:
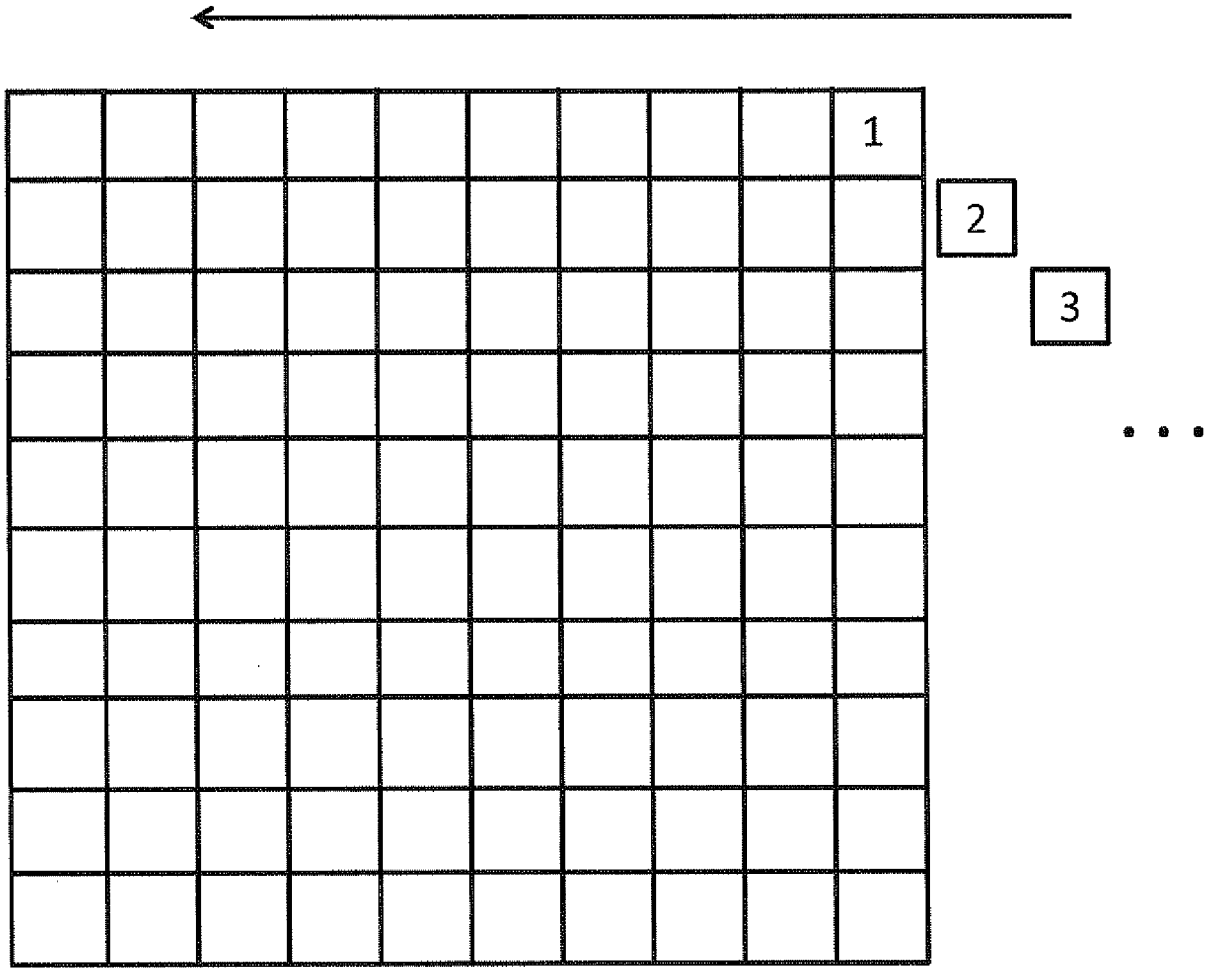
FIGS. 8 through 11 are an expansion and step by step visualization of the process shown in FIG. 7.
Figure 9:
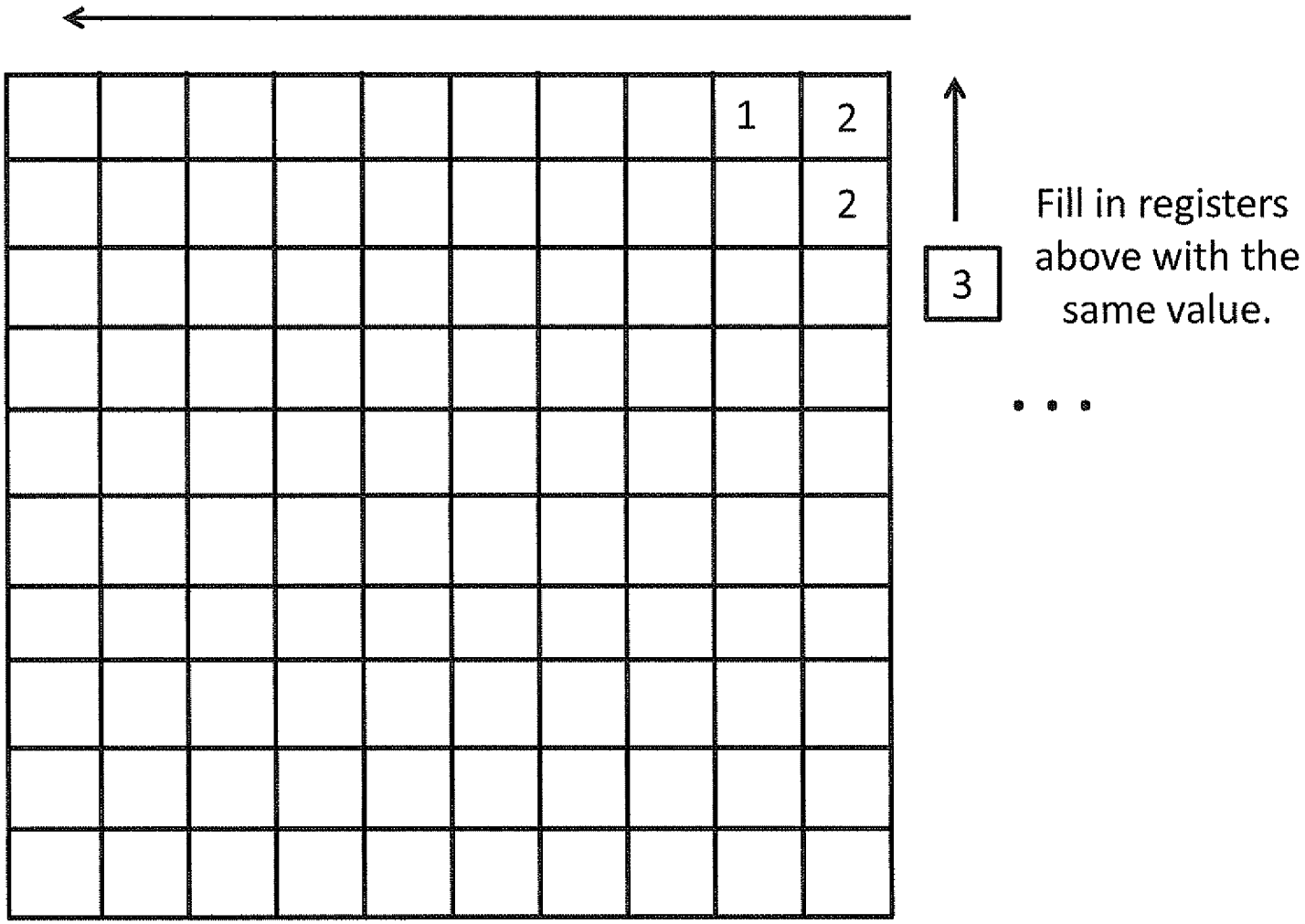
Figure 10:
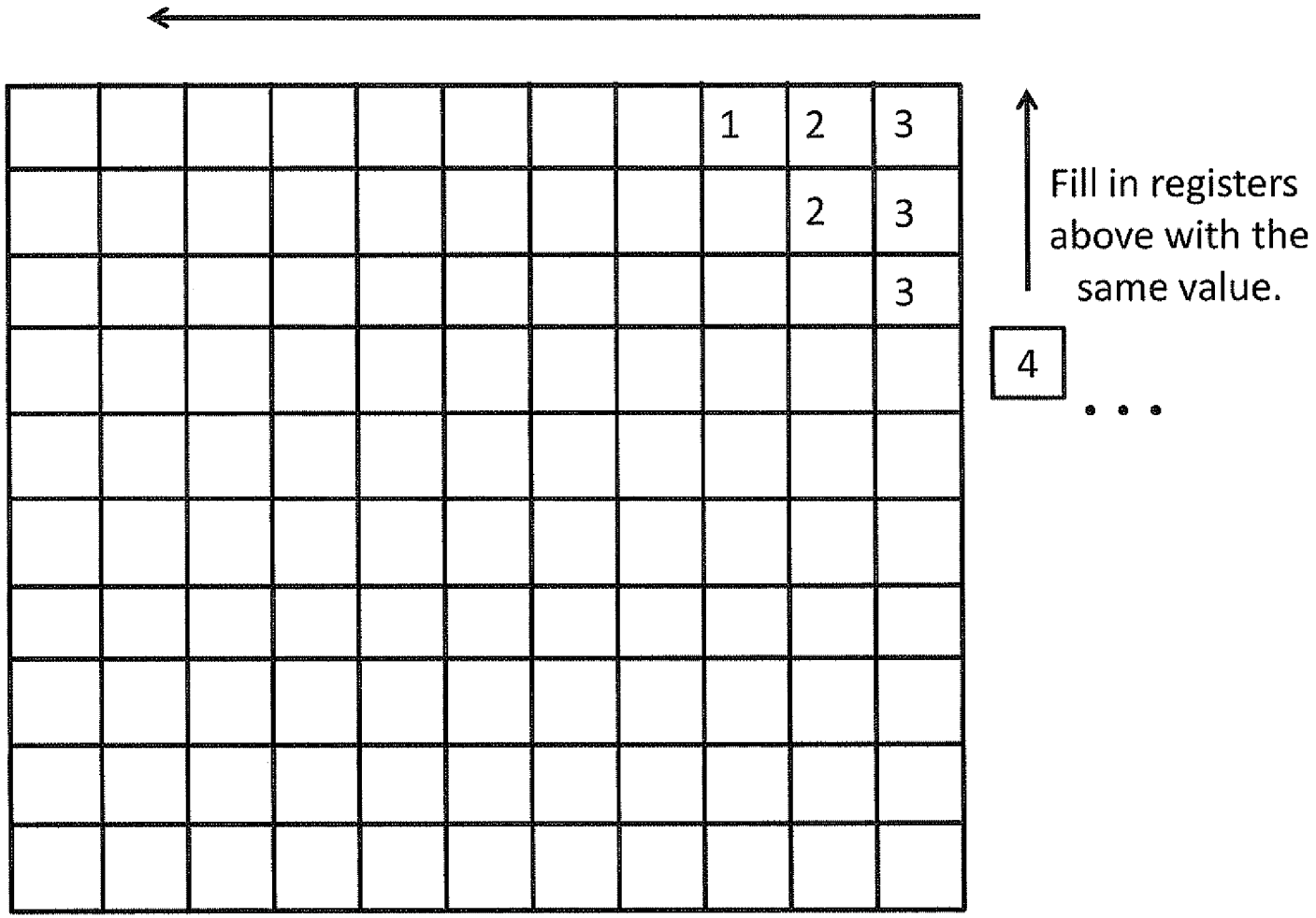
Figure 11:
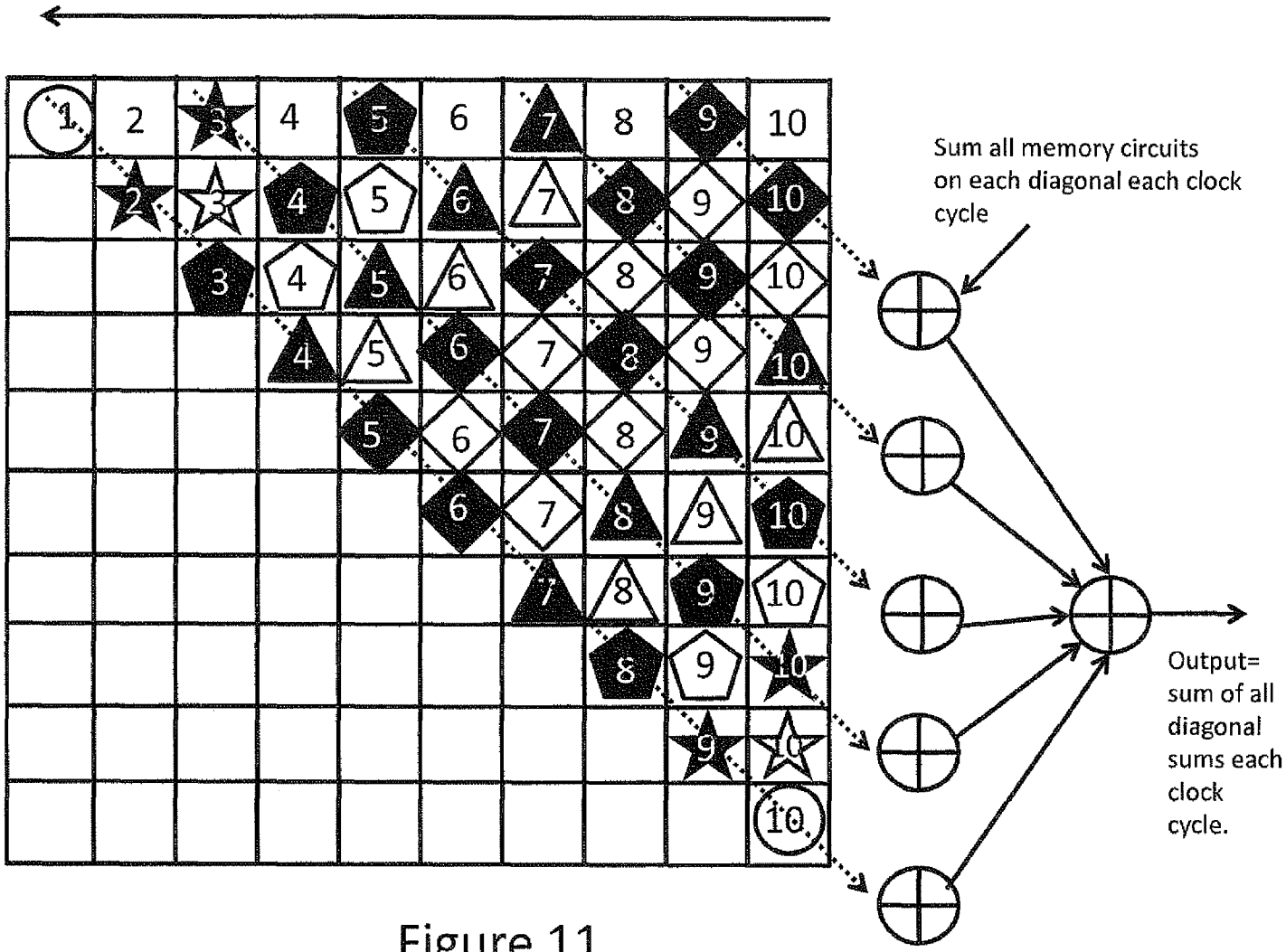

A further implementation of this system and method is to arrange the memory circuits in the form of a matrix. This is unlike any prior art on the subject. The purpose of this is to eliminate the delay that has always been present in prior art. In prior art, there was no output until both sequences passed each other in the middle of the memory registers, or in prior art, called "deltic RAM". In FIG. 7 the input sequence is fed into the upper corner of the memory matrix and the feedback multiplications of FIGS. 5 and 6 are carried out on the diagonals. When this methodology is followed, an output results immediately. FIGS. 8 through 11 show the entire process. Hence unlike all prior art, the output sequence is not necessarily twice as long as the input sequence.

I claim:

1. A system for linear frequency translation, frequency compression, and user selectable response time comprising a signal processing window to receive and split an incoming signal into two separate signals, one duplicate of the incoming signal, and one time-reversed of the incoming signal, or to receive two separate signals where said signal processing window comprises at least two memory locations and two multipliers and two summers and wherein memory circuits are arranged in a memory register matrix with diagonals where data enters a signal path in the middle of memory locations, multipliers and summers and where the diagonals provide signal paths for multiplying and summing an incoming signal.

2. The system of claim 1 where at least one of the signals is decimated before being fed into the signal processing window.

3. The system of claim 2 where the summers, memory locations, and decimators are constructed by digital circuits.

4. The system of claim 2 where the multipliers, summers, memory locations, and decimators are constructed by analog circuits.

5. The system of claim 2 where the multipliers, summers, memory locations, and decimators are constructed by both digital and analog circuits.

6. A method for linear frequency translation, frequency compression, and user selectable response time upon receiving an incoming signal comprising the following steps:

a) providing a signal processing window to receive and split an incoming signal into two separate signals, one duplicate of the incoming signal, and one time-reversed of the incoming signal, or to receive two separate signals where said signal processing window comprises at least two memory locations and two multipliers and two summers, where said multipliers are weighted evenly with a value of "1", b) splitting the incoming signal into two separate signals, one duplicate of the incoming signal, and one time-reversed of the incoming signal, c) shifting the two separate signals past each other in opposite directions at the same rate and said memory locations of one signal are multiplied to corresponding memory locations of the other time-reversed signal and the products are summed, d) decimating one or both of the signals and shifting the two separate signals past each other in opposite directions at different rates and said memory locations of one signal are multiplied to corresponding memory locations of the other time-reversed signal and the products are summed, e) providing memory circuits arranged in a memory register matrix with diagonals where data enters a signal path in the middle of memory locations, multipliers and summers and where the diagonals provide signal paths for multiplying and summing an incoming signal.

7. The method of claim 6 where the multipliers in the step of providing a signal processing window to receive and split an incoming signal into two separate signals, one duplicate of the incoming signal, and one time-reversed of the incoming signal, or to receive two separate signals where said signal processing window comprises at least two memory locations and two multipliers and two summers are weighted individually with different values other than "1".

8. The method of claim 6 where in the step of decimating one or both of the signals and shifting the two separate signals past each other the two separate signals are shifted past each other in the same direction at the same or different rates.

9. A system for linear frequency translation, frequency compression and user selectable response time comprising a signal processing window which utilizes one signal path comprising two or more memory circuits, multipliers, and summers and further comprising the use of feedback paths to emulate two signal paths arranged in opposite directions and thus eliminating the requirement for two signal paths and requiring only one half the circuit elements of prior systems due to the use of feedback paths in the one signal path wherein memory circuits are arranged in a memory register matrix with diagonals where data enters a signal path in the middle of memory locations, multipliers and summers and where the diagonals provide signal paths for multiplying and summing an incoming signal.

10. The system of claim 9 where the number of memory circuits is an even number.

11. The system of claim 9 where the number of memory circuits is an odd number.

12. A method for linear frequency translation, frequency compression, and user selectable response time upon receiving an incoming signal and providing for total autonomy of processing of the non-deterministic, time-varying input signal without any required knowledge of amplitude or phase characteristics of the input signal comprising the following steps:

a) providing a signal processing window which utilizes one signal path comprising two or more memory circuits, multipliers, and summers;

b) direct the incoming signal to one signal path;

c) use feedback paths in one, single signal path to eliminate the requirement for any circuitry to time reverse or induce any type of phase shift into the incoming signal;

d) providing the step of providing memory circuits arranged in a memory register matrix with diagonals where data enters a signal path in the middle of memory locations, multipliers and summers and where the diagonals provide signal paths for multiplying and summing an incoming signal.

13. The method of claim 12 where the number of memory circuits provided is an even number.

14. The method of claim 12 where the number of memory circuits provided is an odd number.

* * * * *